US006327790B1

(12) United States Patent
Sillon

(10) Patent No.: US 6,327,790 B1
(45) Date of Patent: Dec. 11, 2001

(54) METHOD OF CALIBRATING A GRINDING WHEEL FOR GRINDING OPHTHALMIC LENSES, AND CALIBRATION TEMPLATE FOR IMPLEMENTING THE METHOD

(75) Inventor: Christophe Sillon, Mirecourt (FR)

(73) Assignee: Essilor International (Compagnie Generale D'Optique), Charenton le Pont (FR)

( * ) Notice: Subject to any disclaimer, the term of this patent is extended or adjusted under 35 U.S.C. 154(b) by 0 days.

(21) Appl. No.: 09/420,559

(22) Filed: Oct. 19, 1999

(30) Foreign Application Priority Data

Oct. 22, 1998 (FR) ..... 98 13242

(51) Int. Cl.[7] ..... G01B 1/00; G01B 3/14; G01B 21/00

(52) U.S. Cl. ..... 33/562; 33/504; 33/28; 33/613; 33/645; 33/533; 33/626

(58) Field of Search ..... 33/562, 626, 200, 33/507, 28, 613, 645, 533

(56) References Cited

U.S. PATENT DOCUMENTS 4,829,715 5/1989 Langlois et al. .
5,683,288 11/1997 Kujawa .
5,806,198 * 9/1998 Guillermin ..... 33/502
6,071,176 * 6/2000 Kruis ..... 33/28

* cited by examiner

*Primary Examiner*—Diego Gutierrez
*Assistant Examiner*—Yaritza Guadalupe
(74) *Attorney, Agent, or Firm*—Young & Thompson

(57) ABSTRACT

A grinding machine includes a swing-arm mounted to pivot on a frame, a lens-holder shaft which is mounted to rotate on the swing-arm about a rotation axis parallel to the pivot axis of the swing-arm, and on which a calibration template can be mounted, and a tool-holder shaft which is mounted to rotate on the frame at a distance from the pivot axis of the swing-arm and on which a machining tool can be mounted. A method of calibrating the machine includes an approach phase during which the swing-arm, which is fitted with a calibration template, is moved toward the tool-holder shaft, which is equipped with a machining tool. The approach phase is interrupted as soon as contact is detected between the calibration template and the machining tool. Applications include machines for grinding ophthalmic lenses.

22 Claims, 5 Drawing Sheets

METHOD OF CALIBRATING A GRINDING WHEEL FOR GRINDING OPHTHALMIC LENSES, AND CALIBRATION TEMPLATE FOR IMPLEMENTING THE METHOD

BACKGROUND OF THE INVENTION

1. Field of the Invention

The present invention is generally concerned with the calibration that has to be carried out when starting up an ophthalmic lens grinding machine in order to determine with all the required accuracy, relative to its general reference system of axes, various parameters relating to the machining tools that can be used therein, and in particular the position of a machining tool in the reference system of axes, given that the calibration can, and even must, be repeated periodically, in particular when changing or sharpening the machining tool.

The present invention is more particularly directed to the situation in which the grinding machine to be calibrated includes a swing-arm which pivots on a frame, a lens-holder shaft which rotates on the swing-arm about a rotation axis parallel to the pivot axis of the swing-arm, and a tool-holder shaft which is carried by the frame at a distance from the pivot axis of the swing-arm and on which a machining tool can be mounted.

2. Description of the Prior Art

U.S. Pat. No. 5,806,198 proposes substituting a calibration template for a lens on the lens-holder shaft in order to carry out the required calibration, performing an approach phase during which the swing-arm, equipped in this way with a calibration template of this kind, is moved toward the tool-holder shaft, which is equipped with the machining tool whose co-ordinates are to be determined, and having interruption of the approach phase commanded by a sensor provided for this purpose and responsive to contact between the swing-arm and a component, usually referred to as the drive link, which during the machining of a lens drives the swing-arm in accordance with the machining to be effected, providing a support for the swing-arm when sufficient material has been removed.

The above arrangements have proved satisfactory and may continue to do so.

They nevertheless have the following drawbacks.

Firstly, detection occurs at a distance from the lens-holder shaft and from the tool-holder shaft with a lever arm that is less than that of the two shafts, which is detrimental to the accuracy of the results obtained.

Also, and most importantly, once detection has occurred the full weight of the swing-arm rests on the machining tool.

Although some machining tools are able to support a weight of this magnitude without deformation, and this is in fact the case for a grinding wheel, it is not necessarily the case for all possible machining tools.

To be more precise, it has now been proposed to use a relatively fragile machining tool on at least some grinding machines, namely a grooving tool to be used when it is necessary to machine a groove into the edge of a lens.

This is the case in particular with lenses to be mounted in spectacle frames, like those sold under the tradename "Nylor", in which each circle or surround includes a rigid part and a filament which extends from one end of the rigid part to the other.

The grooving tool is usually on a secondary tool-holder shaft separate from and parallel to the main tool-holder shaft carrying one or more grinding wheels, the secondary tool-holder shaft being a simple spindle, for example, extending cantilever fashion from a retractable dedicated frame.

The grooving tool is usually a simple, relatively thin and narrow grinding wheel.

During the approach phase of the calibration process, the weight of the swing-arm resting on a grooving wheel of the above kind would inevitably cause unwanted and unacceptable deformation of the grooving wheel.

A general object of the present invention is an arrangement which avoids the above drawbacks and which in particular prevents deformation of a grooving wheel when calibrating it.

SUMMARY OF THE INVENTION

To be more precise, the present invention consists in a method of calibrating a grinding machine including a swing-arm mounted to pivot on a frame, a lens-holder shaft mounted to rotate on said swing-arm about a rotation axis parallel to the pivot axis of said swing-arm and on which a calibration template can be mounted, and a tool-holder shaft mounted to rotate on said frame at a distance from said pivot axis of said swing-arm and on which a machining tool can be mounted, the method including an approach phase during which said swing-arm, fitted with a calibration template, is moved toward said tool-holder shaft, which is equipped with a machining tool, and in which method said approach phase is interrupted as soon as contact is detected between said calibration template and said machining tool.

Thus, in accordance with the invention, contact is no longer detected between the swing-arm and the drive link driving it, but directly between the calibration template and the machining tool, without the intervention of any lever arm whatsoever, and therefore to the benefit of the accuracy of the results obtained.

In a preferred embodiment of the invention, at least the surface of said machining tool is electrically conductive and said calibration template has at least on its surface at least one electrically insulated conductive part which is electrically connected to an operating circuit, and interruption of said approach phase is conditional on detection by said operating circuit of a current flowing between said conductive part of said calibration template and said machining tool.

For example, the approach phase is preferably interrupted as soon as the current detected by the operating circuit reaches a particular threshold.

Be this as it may, the electrical detection approach has the advantage of avoiding excessive mechanical contact between the grooving tool and the calibration template likely to lead to deformation thereof.

The calibration template preferably used to implement the method of the invention includes at least one electrically insulated conductive part which can be electrically connected to an operating circuit of any kind.

A calibration template of the above kind and the corresponding calibration method can be suitable with equal advantage for calibrating a grinding wheel and for calibrating a grooving wheel.

When, as is usually the case, the axis of the tool-holder shaft on which the grooving wheel is mounted is inclined relative to the axis of the lens-holder shaft, the calibration template of the invention preferably has at least two conductive parts which are insulated from each other and each of which includes at least one contact face forming a dihedron with said contact face of the other one, and after contact has been detected between said contact face of one of said conductive parts of said calibration template and said machining tool, contact is equally caused to be established between said machining tool and the corresponding contact face of the other conductive part of said calibration template.

The calibration template of the invention therefore determines not only the position of the grooving wheel in the system of axes of the grinding machine but also the diameter of the grooving wheel even though, given the inclination of the grooving wheel, it physically senses only an elliptical contour of the grooving wheel.

To this end it exploits the geometrical relationship between the elliptical contour and the real circular contour of the grooving wheel.

The features and advantages of the invention will emerge from the following description which is given by way of example and with reference to the accompanying diagrammatic drawings.

DETAILED DESCRIPTION OF THE PREFERRED EMBODIMENT

Figure 1:
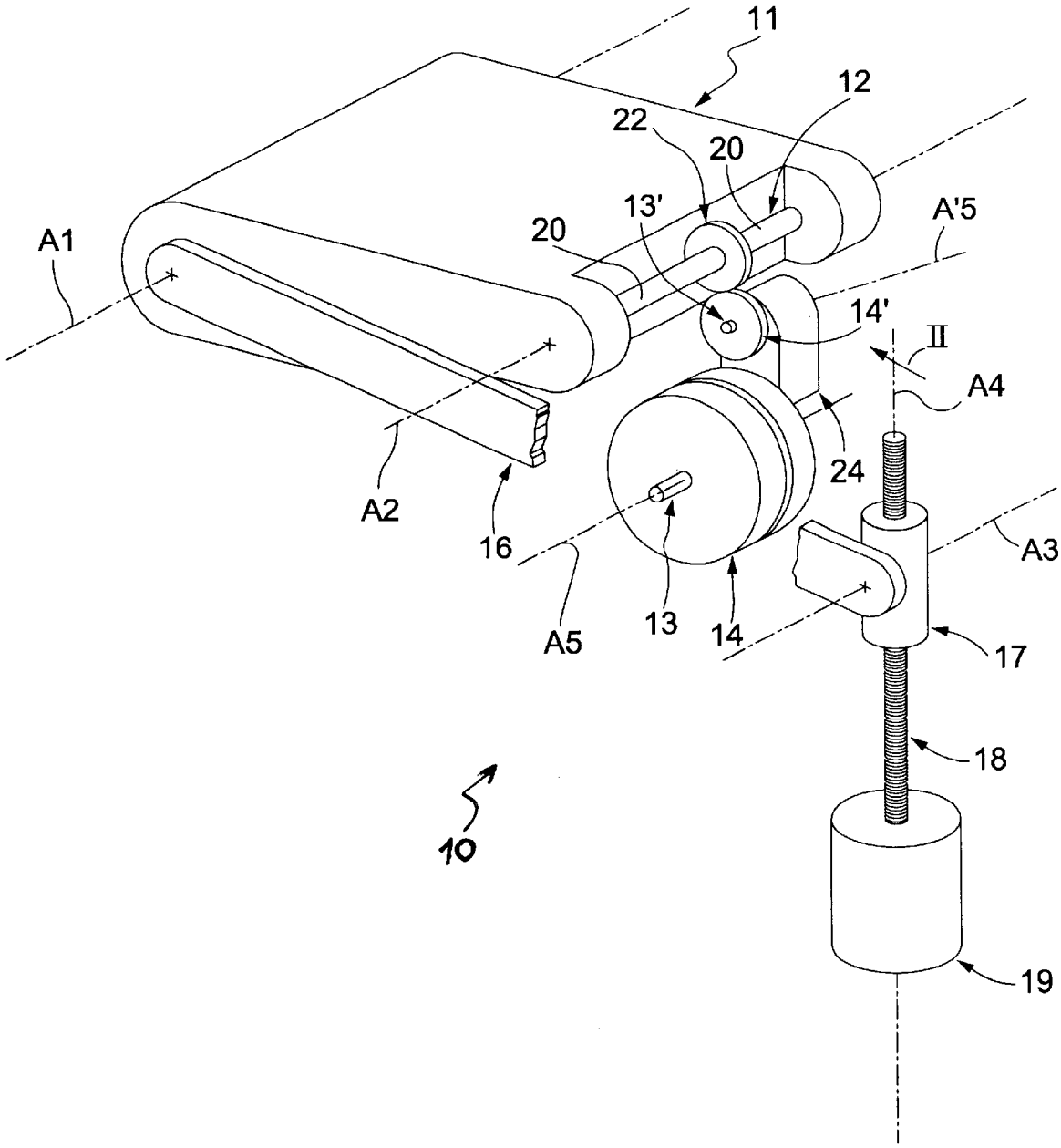
FIG. 1 is a diagrammatic and locally cutaway perspective view of an ophthalmic lens grinding machine to which the invention may be applied.

As shown diagrammatically in FIG. 1, and in a manner that is known in itself, in particular from U.S. Pat. No. 5,806,198 referred to above, a grinding machine 10 that the invention is more particularly intended to calibrate includes a swing-arm 11 mounted to pivot freely on a frame, not shown, about a pivot axis Al which is in practise a horizontal axis, a lens-holder shaft 12 which is mounted to rotate on the swing-arm 11 about a rotation axis A2 parallel to the pivot axis Al thereof, and a tool-holder shaft 13, 13' which is mounted to rotate on the frame at a distance from the pivot axis A1 of the swing-arm 11 and on which a machining tool 14, 14' can be mounted.

The embodiment shown is in practise an automatic grinding machine 10, often referred to as a digital grinding machine, the swing-arm 11 is driven by a drive link 16 whose other end is articulated to a nut 17 about a pivot axis A3 parallel to the pivot axis A1 of the swing-arm 11, and the nut 17 is mobile along an axis A4 orthogonal to the pivot axes A1 and A3.

For example, and as shown diagrammatically in FIG. 1, the nut 17 is a screwthreaded nut screwed onto a screwthreaded rod 18 aligned with the axis A4 and driven in rotation by a motor 19.

The above arrangements are conventional and are not described in more detail here.

In a manner that is also conventional, the lens-holder shaft 12 is formed of two aligned spindles 20 adapted to grip the lens 22 to be machined between them. The lens is an ophthalmic lens in this example.

To machine a bevel on the edge of the lens 22 the machining tool 14 is a grinding wheel.

The rotation axis A5 of the corresponding tool-holder shaft 13 is parallel to the pivot axis A1 of the spring-arm 11 and the rotation axis A2 of the lens-holder shaft 12.

To machine a groove in to the edge of the lens 22 the machining tool 14' is a grooving tool.

Figure 2:
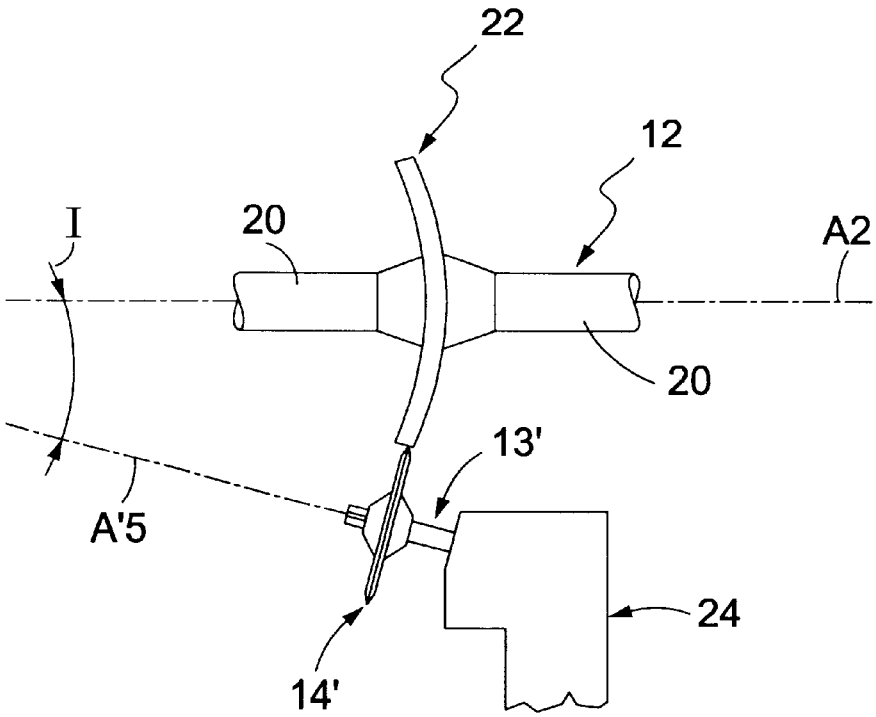
FIG. 2 is a partial elevation view of the grinding machine to a larger scale and as seen in the direction of the arrow II in FIG. 1.

In practise, and as seen more clearly in FIG. 2, the machining tool 14' is a simple grooving wheel, i.e. a relatively thin and narrow metal disk.

In practise, and also as shown in FIG. 2, the rotation axis A'5 of the corresponding tool-holder shaft 13' is inclined to the rotation axis A2 of the lens-holder shaft 12.

The corresponding angle of inclination I is in the order of 15°, for example.

For example, and as shown here, the tool-holder shaft 13' is a simple spindle which extends cantilever fashion from an auxiliary frame 24. The auxiliary frame 24 lies over the machining tool 14 in use, is constrained to move in translation with the tool-holder carriage and is retractable relative to the machining tool 14.

The foregoing arrangements are also conventional and are not described in more detail here.

Figure 3:
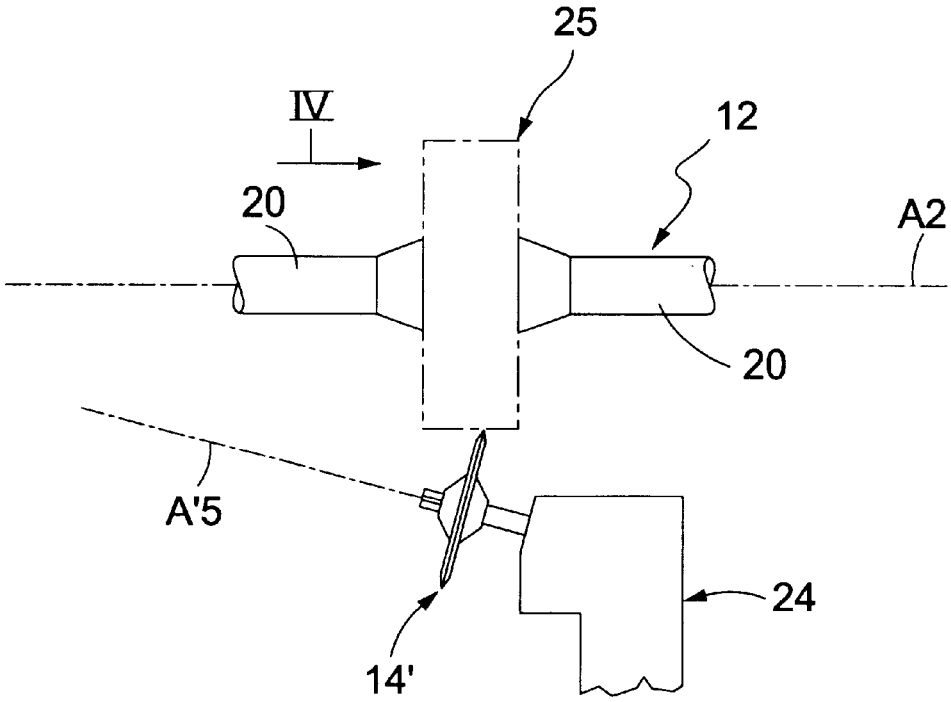
FIG. 3 is a partial view in elevation showing the fitting of a calibration template of the invention to the grinding machine instead of a lens.

In a conventional manner, and as shown diagrammatically in FIG. 3, a calibration template 25 is used to calibrate the grinding machine 10, being substituted for a lens 22 on the lens-holder shaft 12, and the corresponding calibration process includes an approach phase during which the swing-arm 11 equipped in this way with the calibration template 25 is moved toward the tool-holder shaft 13, 13' concerned, which is fitted with the corresponding machining tool 14, 14'.

In accordance with the invention, and for reasons that will become apparent hereinafter, the calibration template 25 has, at least on its surface, at least one electrically insulated conductive part 26A, 26B which, as shown diagrammatically in FIG. 9, can be electrically connected to an operating circuit 27 of any kind.

As is the case in the embodiment shown, the calibration template 25 preferably has at least two conductive parts 26A, 26B which are insulated from each other and each of which includes at least one contact face 28A, 28B forming a dihedron D with the contact face 28B, 28A of the other one.

In the embodiment shown, there are only two conductive parts 26A, 26B.

For example, and as shown here, the two conductive parts 26A, 26B each include a flange 29A, 29B by means of which they are attached to a hub 30, at a distance from each other, and facing which their contact face 28A, 28B is generally L-shaped.

In practise the hub 30 is made of an insulative material.

In practise its middle portion forms a flange 31 against which the flanges 29A, 29B of the conductive parts 26A, 26B lie.

For example, the flange 29B of the conductive part 26B is attached to the flange 31 by screws, not shown.

The flange 29A of the conductive part 26A is also attached to the flange 31 by screws, also not shown.

In the embodiment shown, the hub 30 carries an electrically conductive material bush 33 projecting cantilever fashion from one of its ends, for coupling it to the lens-carrier shaft 12, to be more precise to one of the spindles 20 constituting the lens-holder shaft 12.

In practise, the bush 33 is a metal bush.

In the embodiment shown, it extends from the same end as the conductive part 26A and an insulative material ring 34 is inserted between it and the flange 29A of the conductive part 26A.

A notch 35 constrains the bush 33 to rotate with the spindle 20 concerned of the lens-holder shaft 12 and a screw 36 retains it axially relative to that spindle.

As is the case in the embodiment shown, the flanges 29A, 29B of the conductive parts 26A, 26B are preferably parallel to each other and substantially perpendicular to the axis A6 of the hub 30.

Their contact face 28A, 28B is preferably plane.

In the embodiment shown, the contact face 28A of the conductive part 26A is part of a boss 38A on the back of the flange 29A, in line with a beak-shaped portion 39A formed thereby.

In this embodiment, the contact face 28B of the conductive part 26B is part of a simple right-angled rim 38B on the flange 29B of the conductive part 26B.

As is the case in the embodiment shown, the dihedron D formed in this way by the contact face 28A of one of the conductive parts 26A, 26B, in this instance the conductive part 26A, and the corresponding contact face 28B of the other conductive part 26A, 26B, in this instance the conductive part 26B, is a right-angled dihedron.

In other words, the angle of the dihedron D is substantially equal to 90°.

As is the case in the embodiment shown, each of the conductive parts 26A, 26B preferably includes at least three angularly offset contact faces 28A, 28'A, 28"A, 28B, 28'B, 28"B and the respective contact faces 28A, 28'A, 28"A, 28B, 28'B, 28"B of the conductive parts 26A, 26B are associated in pairs of contact faces 28A–28'A, 28B–28'B, 28"A–28"B forming a dihedron D, D' D" between them.

In addition to the contact faces 28A, 28B already described, there are therefore additional contact faces 28'A, 28"A, 28'B, 28"B on the conductive parts 26A, 26B in the embodiments shown.

In the case of the conductive part 26A, the contact faces 28'A, 28"A are parts of a respective right-angled rim 40'A, 40"A on the flange 29A.

In the case of the conductive part 26B, the contact faces 28'B, 28"B are parts of a respective boss 40'B, 40"B on the back of the flange 29B.

The contact faces 28A, 28'A, 28"A of the conductive part 26A face toward the conductive part 26B and the contact faces 28B, 28'B, 28"B of the conductive part 26B face towards the conductive part 26A.

As is the case in the embodiment shown, the contact faces 28A, 28'A, 28"A, 28B, 28'B, 28"B of each of the conductive parts 26A, 26B are preferably angularly offset by an angle substantially equal to 90°.

In practise both the conductive parts 26A, 26B are made of metal and incorporate a bore 42A, 42B in the central area of their flange 29A, 29B for fitting them to the hub 30.

In the embodiment shown, the bore 42A in the conductive part 26A is surrounded by a flange 43 on the side opposite the conductive part 26B.

Figure 4:
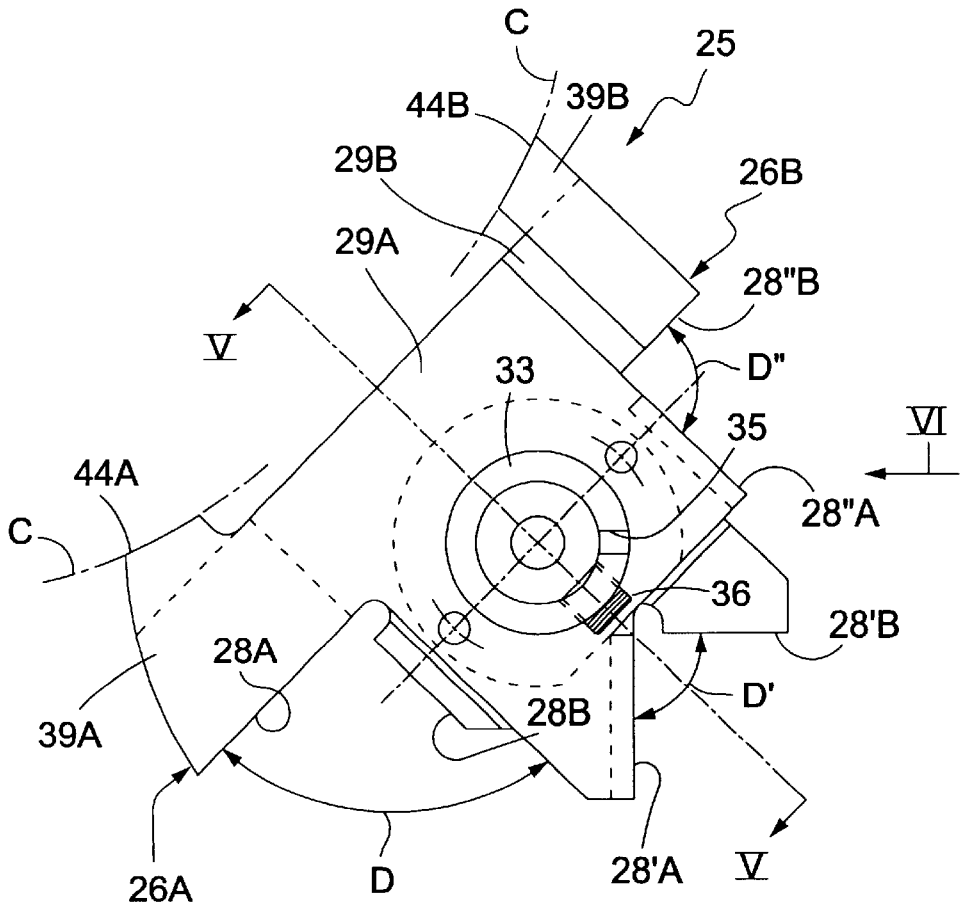
FIG. 4 is a side view of the template to a larger scale and as seen in the direction of the arrow IV in FIG. 3.
Figure 5:
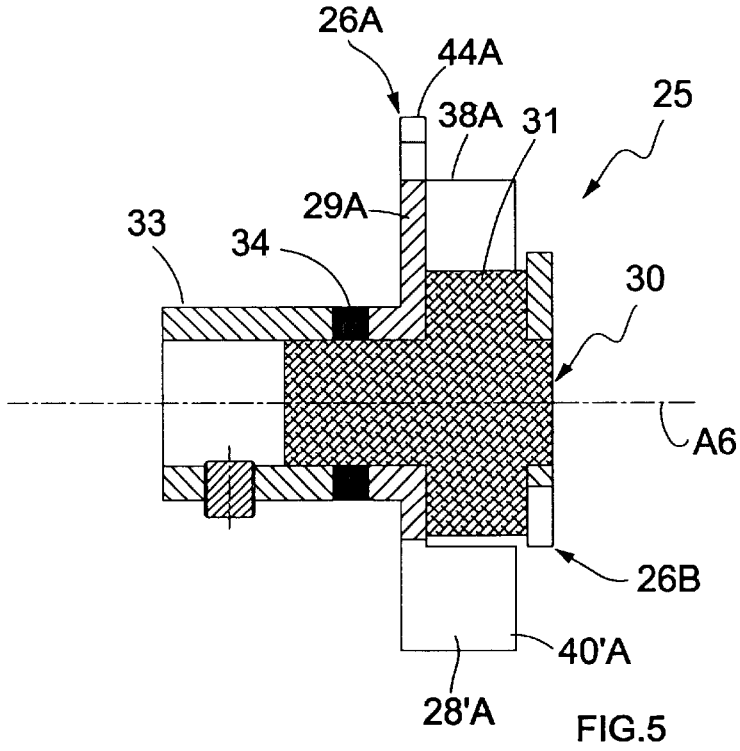
FIG. 5 is a view of the template in axial section taken along the line V–V in FIG. 4.
Figure 6:
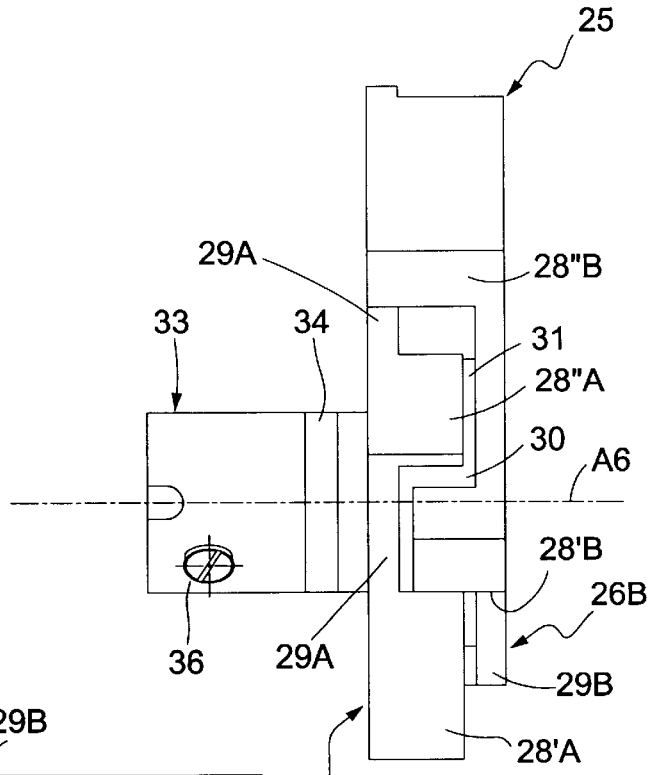
FIG. 6 is a front view of the template as seen in the direction of the arrow VI in FIG. 4.
Figure 8:
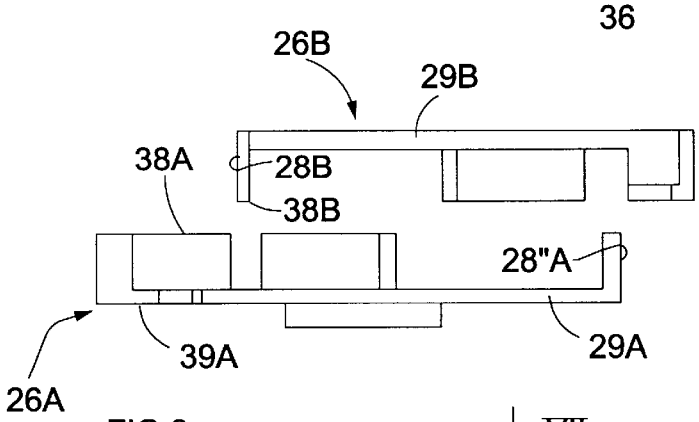
FIG. 8 is a plan view of the two conductive parts as seen in the direction of the arrow VIII in FIG. 7.
Figure 7:
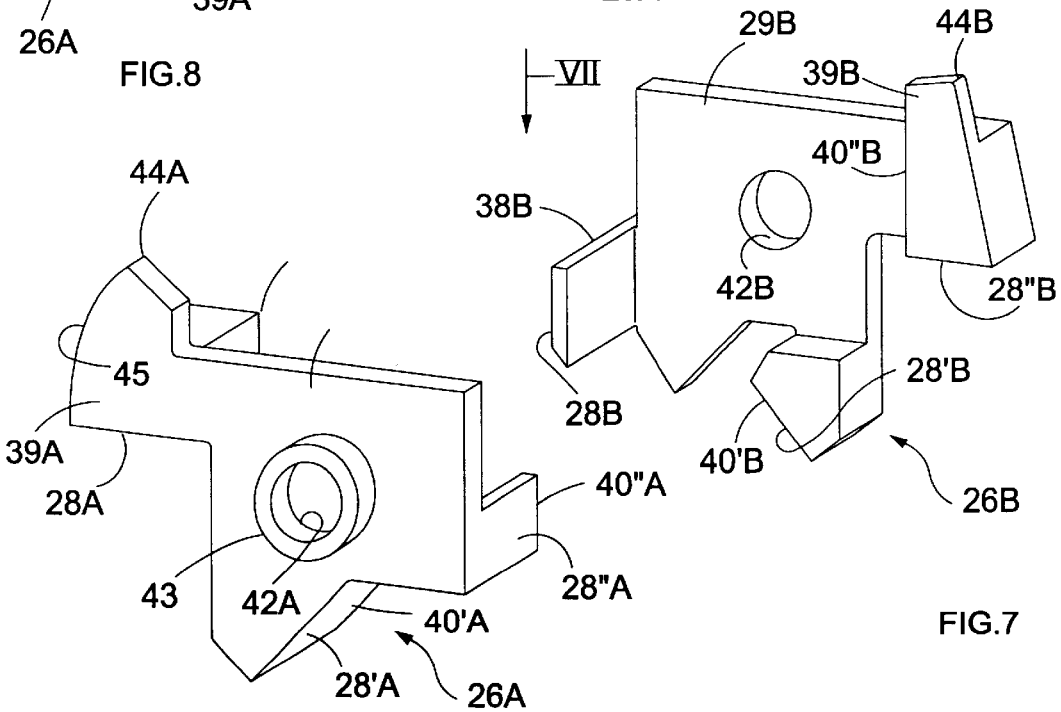
FIG. 7 is an exploded perspective view of two conductive parts of the calibration template of the invention.

In the embodiment shown, and for reasons that will become apparent hereinafter, the outside contour of the calibration template 25 of the invention forms two localized angular points 44A, 44B, each of which is part of the respective conductive part 26A, 26B. Circumscribed by the same circumference C, as shown diagrammatically in FIG. 4 in chain-dotted line, they are angularly offset from each other.

In the embodiment shown, the angular point 44A of the conductive part 26A is in practise part of the beak-shaped portion 39A of its flange 29A and the angular point 44B of the conductive part 26B is part of a beak-shaped portion 39B which locally extends it boss 40"B.

In the embodiment shown, and for reasons which will also become apparent hereinafter, the outside contour of the calibration template 25 of the invention is circular over at least a portion 45 of its periphery.

In this embodiment, this circular portion 45 of its outside contour is in practise limited to the edge of the beak-shaped portion 39A of the flange 29A of the conductive part 26A.

Figure 9:
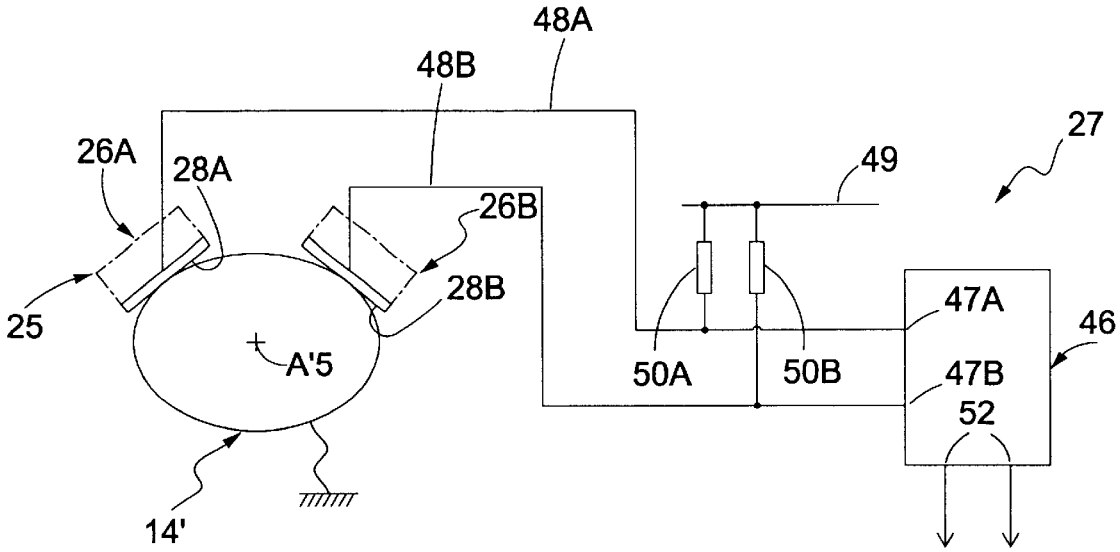
FIG. 9 is a block diagram of the operating circuit to which the calibration template of the invention can be connected.

As shown diagrammatically in FIG. 9, the operating circuit 27 essentially includes a microprocessor 46 which has a port 47A connected to the conductive part 26A of the calibration template 25 by an electrical conductor 48A and another port 47B connected to the conductive part 26B of the calibration template 25 by an electrical conductor 48B. 20 The ports 47A, 47B of the microprocessor 46 receive a particular voltage, in the order of 5 V, for example, from a busbar 49 via a current limiter resistor 50A, 50B.

Outputs 52 of the microprocessor 46 control the grinding machine 10, in particular pivoting of its swing-arm 11 about its pivot axis A1 and rotation of its lens-holder shaft 12 about its rotation axis A2.

The microprocessor 46 is wired to discriminate between a zero voltage and a voltage equal to the voltage on the busbar 49 at each of its ports 47A, 47B.

The corresponding arrangements will be obvious to the skilled person and are therefore not described in more detail here.

It is assumed hereinafter that the grinding machine 10 is calibrated when the machining tool 14', i.e. a grooving wheel, is used on the machine.

In accordance with the invention, the approach phase of the corresponding calibration process is interrupted as soon as contact is detected between the calibration template 25 and the machining tool 14'.

To achieve this, the invention preferably exploits the fact that at least the surface of the machining tool 14' is electrically conductive.

As already indicated hereinabove, the grooving wheel constituting the machining tool 14' is usually made of metal.

In accordance with the invention, and as shown diagrammatically in FIG. 9, the machining tool 14' is grounded; in practise this applies also to the bush 33 carried by the hub 30 of the calibration template 25.

In accordance with the invention, interruption of the approach phase of the calibration process is preferably conditional on detection by the operating circuit 27 of a current flowing between the conductive part 26A, 26B of the calibration template 25 and the machining tool 14'.

In practise, and by means of arrangements that will be obvious to the skilled person and are not described here, this current is detected by the microprocessor 46 of the operating circuit 27, by virtue of its ability to discriminate between the voltages at one and/or the other of its ports 47A, 47B.

To be more precise, in accordance with the invention, the approach phase is interrupted as soon as the current detected by the operating circuit 27 reaches a particular threshold.

The procedure used in practise can be as follows, for example:

As shown diagrammatically in FIG. 9, after contact has been detected between the contact face 28A of one of the conductive parts 26A, 26B of the calibration template 25, in this instance its conductive part 26A, and the machining tool 14', contact is also caused to be established between the machining tool 14' and the corresponding contact face 28B of the other conductive part 26A, 26B of the calibration template 25, which in this instance is its conductive part 26B.

To achieve this it is sufficient to command pivoting of the swing-arm 11 and/or rotation of the lens-holder shaft 12.

In practise this is done automatically by the microprocessor 46 of the operating circuit 27.

As soon as contact is established between a contact face 28A, 28B of the calibration template 25 and the machining tool 14', the voltage at the corresponding gate 47A, 47B of the microprocessor 46 changes from the voltage on the busbar 49 to a zero (ground) voltage, which constitutes the required detection.

When, as here, each of the two conductive parts 26A, 26B of the calibration template 25 includes at least three angularly offset contact faces 28A, 28'A, 28"A, 28B, 28'B, 28"B associated in pairs, with one on each of the conductive parts 26A, 26B, the operations are repeated for each pair 28A–28B, 28'A–28'B, 28"A–28"B of contact faces 28A, 28'A, 28"A, 28B, 28'B, 28"B.

Be this at it may, as indicated above, as soon as contact is detected between the calibration template 25 and the machining tool 14', the coordinates of the position of the calibration template 25 in the system of axes of the grinding machine 10 are noted.

In practise these coordinates allow for the angular orientations of the swing-arm 11 and the lens-holder shaft 12.

The position of the machining tool 14' in the system of axes of the grinding machine 10 is then calculated from these coordinates.

When, as here, the machining tool 14' is a grooving tool mounted on a tool-holder shaft 13' whose rotation axis A'5 is inclined to the rotation axis A2 of the lens-holder shaft 12, the radius R of the machining tool 14' is deduced from the coordinates of the calibration template 25 successively established, by the above method, using the pairs of contact faces 28A–28B, 28'A–28'B, 28"A–28"B, using geometrical properties relating an ellipse and the corresponding orthoptic or Monge circle.

Figure 10:
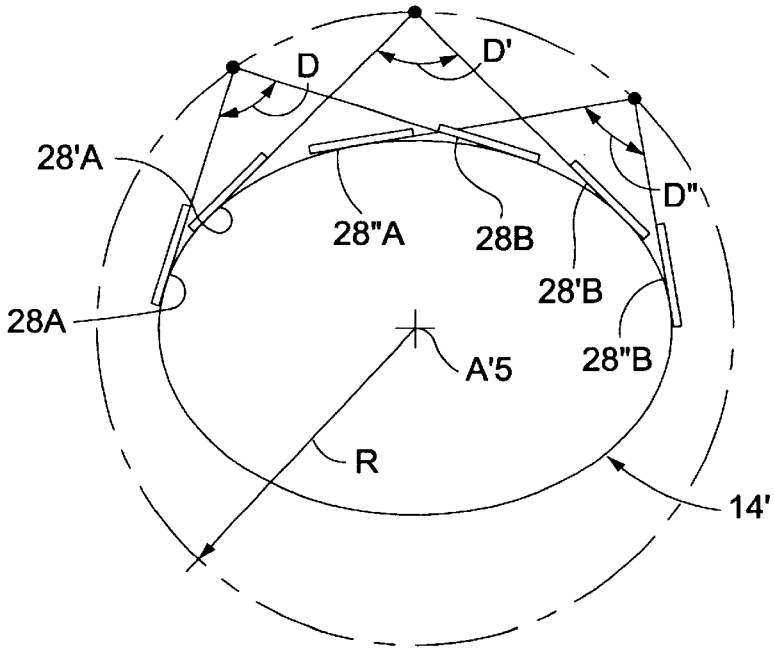
FIG. 10 is a block diagram illustrating one particular mode of use of the calibration template.

This is shown diagrammatically in the FIG. 10 block diagram.

The aforementioned geometrical properties are well known to the skilled person and are not explained here.

They are apparent from the FIG. 10 block diagram anyway.

Likewise, the calculation for deducing the position of the machining tool 14' and its radius R from the coordinates of the calibration template 25 will be obvious to the skilled person and is not described in more detail here either.

If the grinding machine 10 is equipped with a machining tool 14, in this instance one or more grinding wheels, it is calibrated by means of the angular points 44A, 44B and the portion 45 with a circular contour of the periphery of the calibration template 25, using methods described in U.S. Pat. No. 5,806,198.

Of course, the present invention is not limited to the embodiment and/or the application described and shown, but encompasses any variant execution thereof.

What is claimed is:

1. A method of calibrating a grinding machine including a swing-arm mounted to pivot on a frame, a lens-holder shaft mounted to rotate on said swing-arm about a rotation axis parallel to the pivot axis of said swing-arm and on which a calibration template can be mounted, and a tool-holder shaft mounted to rotate on said frame at a distance from said pivot axis of said swing-arm and on which a machining tool can be mounted, the method comprising the steps of: effecting an approach phase including moving said swing-arm fitted with a calibration template toward said tool-holder shaft equipped with a machining tool, detecting contact between said calibration template and said machining tool, and interrupting the approach phase as soon as contact is detected.

2. The method claimed in claim 1, wherein at least a surface of said machining tool is electrically conductive and said calibration template has at least on its surface at least one electrically insulated conductive part which is electrically connected to an operating circuit, and the step of interrupting said approach phase is conditional on detection by said operating circuit of a current flowing between said conductive part of said calibration template and said machining tool.

3. The method claimed in claim 2, wherein the approach phase is interrupted as soon as said current detected by said operating circuit reaches a particular threshold.

4. The method claimed in claim 1, wherein said machining tool is a grooving tool mounted on a tool-holder shaft whose rotation axis is inclined to the rotation axis of said lens-holder shaft and said calibration template has at least two conductive parts insulated from each other, said at least two conductive parts having at least one contact face forming a dihedron with a said contact face of another of said at least two conductive parts, and after detecting contact between said contact face of one of said conductive parts of said calibration template and said machining tool, causing contact to be established between said machining tool and said contact face of the other of said conductive parts of said calibration template.

5. The method claimed in claim 4, wherein said calibration template has two said conductive parts, each of said two conductive parts having at least three angularly offset contact faces, said three angularly offset contact faces of one of said conductive parts being arranged in pairs with said three angularly offset faces of the other of said conductive parts, and the steps are repeated for each of said pairs of contact faces.

6. The method claimed in claim 1, wherein coordinates of said calibration template are determined as soon as contact is detected between said calibration template and said machining tool.

7. The method claim in claim 6, wherein the position of said machining tool relative to the axes of said grinding machine is calculated from said coordinates of said calibration template.

8. The method claimed in claim 7, wherein said machining tool is a grooving machining tool, a position of said grooving machining tool and the radius of said machining tool being calculated relative to the axes of said grinding machine from said coordinates of said calibration template.

9. The method according to claim 1, wherein said detecting step comprises detecting contact between respective surfaces of said calibration template and said machining tool.

10. The method according to claim 1, wherein said detecting step comprises detecting contact between electrically conductive material of said calibration template and electrically conductive material of said machining tool.

11. The method according to claim 10, wherein said detecting step comprising detecting current flow between the electrically conductive material of said calibration template and said machining tool.

12. The method according to claim 11, wherein said detecting step comprises detecting a threshold level of current flow between the electrically conductive material of said calibration template and said machining tool.

13. In a grinding machine including a swing-arm mounted to pivot on a frame, a lens-holder shaft mounted to rotate on the swing-arm about a rotation axis parallel to the pivot axis of the swing-arm, a calibration template mountable on the lens-holder shaft, a tool-holder shaft for mounting a machining tool, the tool-holder shaft being rotatably mounted on the frame between at a distance from the pivot axis of the swing-arm, the calibration template being movable with the swing-arm toward the tool-holder shaft, the improvement comprising said calibration template including at least one electrically conductive part engageable with an electrically conductive surface of the machining tool, and means for detecting electrical contact between said at least one electrically conductive part of the calibration template and the electrically conductive surface of the machining tool.

14. The improvement according to claim 13, wherein said means for detecting comprises an operating circuit for detecting electric current flowing between said at least one electrically conductive part and said electrically conductive surface.

15. The improvement according to claim 13, wherein said calibration template includes at least two conductive parts electrically insulated from each other, each of said conductive parts having at least one contact face forming an dihedron with a said contact face of another of said conductive parts.

16. The improvement according to claim 15, wherein said dihedron is a right angle dihedron.

17. The improvement according to claim 15, wherein said conductive parts have respective flanges attached to an insulative material hub at spaced locations, includes a flange for attachment at a distance from each other to an insulative material hub, said contact faces being at right angles to the flanges of said conductive parts.

18. The improvement according to claim 17, wherein said hub carries an electrically conductive material bush for coupling said hub to said lens-holder shaft.

19. The improvement according to claim 15, each of said conductive parts has at least three angularly offset contact faces, said three angularly offset contact faces of one of said conductive parts being arranged in pairs and forming dihedrons with said three angularly offset faces of the other of said conductive parts.

20. The improvement according to claim 19, wherein said contact faces of each of said conductive parts are angularly offset by a substantially right angle.

21. The improvement according to claim 15, wherein said calibration template has an outside contour forming two localized angular points, each of the angular points being part of one of said two conductive parts, said angular points being circumscribed by a common circumference and angularly offset from each other.

22. The improvement according to claim 21, wherein a portion of the outside contour in said calibration template is circular.

* * * * *